US005439107A

United States Patent [19]

Penet et al.

[11] Patent Number: 5,439,107

[45] Date of Patent: Aug. 8, 1995

[54] SUPPORT FOR A PAIR OF TEXTILE ARTICLES OF FOOTWEAR

[76] Inventors: Pascale Penet; Jean-Marie Monnier, both of 9bis, rue du grand chemin, 59100 Roubaix, France

[21] Appl. No.: 258,618

[22] Filed: Jun. 16, 1994

[51] Int. Cl.[6] ..... B65D 85/18

[52] U.S. Cl. ..... 206/292; 229/120.18; 229/120.21

[58] Field of Search ..... 206/45.14, 292, 299, 206/45.21; 229/120.21, 120.18

[56] References Cited

U.S. PATENT DOCUMENTS

| | | | |
|---|---|---|---|
| 2,724,542 | 11/1955 | Nemoede | 206/45.14 X |
| 2,727,622 | 12/1955 | Neumann . | |
| 2,917,163 | 12/1959 | Baker et al. | 206/299 X |
| 2,968,393 | 1/1961 | Phillips, Jr. | 206/299 X |
| 3,325,079 | 6/1967 | Puckett | 206/45.14 |
| 4,257,522 | 3/1981 | Thorneburg . | |
| 4,685,267 | 8/1987 | Workman | 229/120.18 X |

FOREIGN PATENT DOCUMENTS

| | | | |
|---|---|---|---|
| 511212 | 3/1955 | Canada | 229/120.18 |
| 1180563 | 6/1959 | France | 229/120.18 |

*Primary Examiner*—Allan N. Shoap
*Assistant Examiner*—Christopher J. McDonald
*Attorney, Agent, or Firm*—Foley & Lardner

[57] ABSTRACT

This invention relates to a support for a pair of textile articles of footwear, made from a sheet of foldable, rigid or semi-rigid material, comprising:

a principal rectangular part, with two transverse zones of fold which define three foldable sides, and two lateral flaps which respectively extend, via a longitudinal zone of fold, each lateral edge of a foldable side, called first principal side; a first lateral flap terminates in two adjacent tabs which are transverse with respect to the principal part of the support and which are adapted to receive by fitting the two articles of footwear positioned side by side and flat, and said support constitutes a closed envelope, once the two lateral flaps have been folded over the inner face of the first principal side, on the one hand, and, on the other hand, once the other two sides have been folded down.

8 Claims, 4 Drawing Sheets

SUPPORT FOR A PAIR OF TEXTILE ARTICLES OF FOOTWEAR

FIELD OF THE INVENTION

The present invention relates to a support for a pair of textile footwear articles, of the sock type. More particularly, it relates to a foldable support which serves both to package and to display for sale a pair of textile footwear articles.

BACKGROUND OF THE INVENTION

U.S. Pat. No. 4,257,522 already discloses a foldable support made from a sheet of foldable, rigid or semi-rigid material, allowing both packaging of a pair of socks and display thereof on shelves in stores. In this type of support, the two socks are presented for sale, folded on themselves and superposed on each other. This support therefore presents the drawback of showing the customers only one sock out of the two. Moreover, by its configuration, the face of the single sock which is visible is for the most part concealed by the support.

U.S. Pat. No. 2,727,622 furthermore discloses a support for an article of clothing of the tie or scarf type, acting as greetings card. That face of the greetings card which is covered by the article of clothing has a pattern printed thereon, complementary of the one printed on the article of clothing. In order to post this greeting card by mail, it must be inserted in an envelope.

It is an object of the present invention to propose a support for a pair of footwear articles which at the same time offers an attractive presentation of the two articles and may be converted, simply by being folded, into a package of the envelope type in order to enable the pair of footwear articles to be sent by post.

SUMMARY OF THE INVENTION

This object is perfectly achieved by the support according to the invention for a pair of textile footwear articles. This support is made from a sheet of foldable, rigid or semi-rigid material, comprising:

- a principal rectangular part, with two transverse zones of fold which define three foldable sides,
- and two lateral flaps which respectively extend, via a longitudinal zone of fold, each lateral edge of a foldable side, called first principal side; wherein a first lateral flap terminates in two adjacent tabs which are transverse with respect to the principal part of the support and which are adapted to receive by fitting the two articles of footwear positioned side by side and flat;

and the support constitutes a closed envelope, on the one hand, once the two lateral flaps have been folded over the inner face of the first principal side and, on the other hand, once the other two sides have been folded down.

When the support is used for display, the two articles of footwear are fitted side by side on the tabs of the first lateral flap and only this first lateral flap is in position folded over the inner face of the first principal side. Each article of footwear is therefore perfectly visible. In order to pack the pair of articles of footwear thus displayed for sale, it suffices to fold the second lateral flap on the pair of articles, then to fold the other two foldable sides so as to constitute the envelope. Once this simple folding operation is terminated, the support containing the pair of articles is ready to be stamped and posted. The juxtaposed position of the articles makes it possible not only to provide an attractive presentation of the two articles for sale, but also advantageously to obtain an envelope of small thickness compared to a package in which the two articles are superposed with respect to each other.

In a first particular embodiment of the support, one of the foldable sides, called second principal side, is adjacent the first principal side and is substantially identical thereto, and the third foldable side, called closure side, makes it possible to connect the first and second principal sides in position folded one above the other, when the support constitutes a closed envelope.

In a second particular embodiment of the support, the second lateral flap is substantially identical to the first principal side and the first principal side is located between the other two foldable sides, called closure sides, with the result that the support constitutes a closed envelope once the second lateral flap has been folded over the first lateral flap and two closure sides have been folded over the outer face of the second lateral flap.

BRIEF DESCRIPTION OF THE DRAWINGS

The invention will be more readily understood on reading the following description with reference to the accompanying drawings, in which.

DESCRIPTION OF PREFERRED EMBODIMENTS

Figure 1:
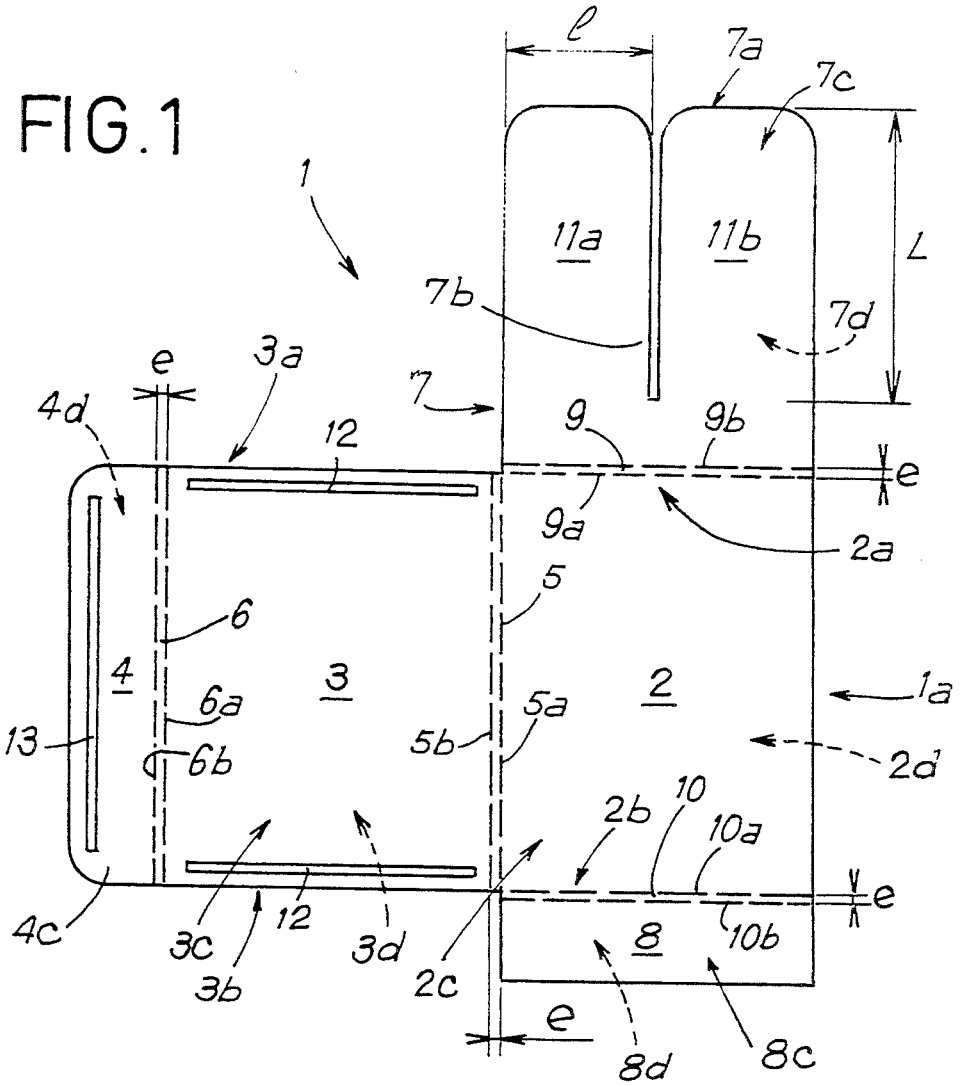
FIG. 1 shows a sheet of cardboard, flat, constituting a first embodiment of a foldable support according to the invention.
Figure 5:
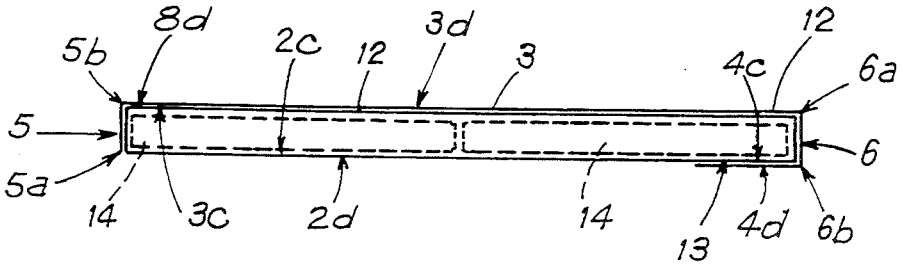
FIG. 5 is a side view of the support and the pair of socks of FIG. 3, once the support has been transformed into an envelope containing the two socks.

Referring now to the drawings and firstly to the first embodiment illustrated in FIG. 1, the support of the invention is made from a sheet 1 of foldable cardboard. This sheet of cardboard comprises a principal part 1*a* of rectangular shape, with two transverse zones of fold 5 and 6, which divide the principal part 1*a* into three foldable sides 2, 3 and 4. The two adjacent sides 2 and 3 separated by the zone of fold 5 are respectively called first and second principal side and have substantially the same dimensions. The side 4 separated from the principal side 3 by the zone of fold 6 is called closure side and makes it possible to connect the two principal sides 2 and 3 in folded position as will be described with reference to FIG. 5.

Sheet 1 also comprises two lateral flaps 7 and 8 which transversely extend the lateral edges 2*a* and 2*b* of the first principal side 2, via two zones of fold 9 and 10, respectively.

The first lateral flap 7 is a rectangle in which has been made a median cut-out 7*b* of length L from the edge 7*a* of the lateral flap 7, which edge 7*a* is opposite the zone of fold 9. The first lateral flap 7 therefore terminates in two adjacent tabs 11*a* and 11*b*, of the same width l and of length L; these two tabs 11*a*, 11*b* are transverse with respect to the principal part 1*a* of the sheet 1. The second lateral flap 8 is a rectangle of small dimensions, but it might have the same surface area as the first lateral flap 7.

All the zones of fold 5, 6, 9 and 10 have substantially the same width R and are each defined by two parallel lines of fold shown in dashed lines in FIG. 1. The two lines of fold of zone 5 are referenced 5*a* and 5*b*, the two lines of fold of zone 6 are referenced 6*a* and 6*b*.

By convention, faces 2*c*, 2*c*, 4*c*, 7*c*, 8*c* respectively of the foldable sides 2, 3 and 4 and of the two lateral flaps 7 and 8 are called inner faces; these inner faces correspond to those faces which are visible in the flat representation of FIG. 1; faces referenced 2*d*, 3*d*, 4*d*, 7*d* are called outer faces. The inner face 3*c* of the second principal side 3 comprises two longitudinal adhesive zones 12, located in the vicinity of and along the longitudinal edges 3*a* and 3*b* of this side 3. The inner face 4*c* of the closure side 4 comprises a transverse adhesive zone 13. These adhesive zones 12 and 13 are constituted for example by double-face, self-adhesive strips. They allow the support to be gummed when the latter is folded so as to constitute a closed envelope, as will subsequently be described with reference to FIG. 5.

Figure 2:
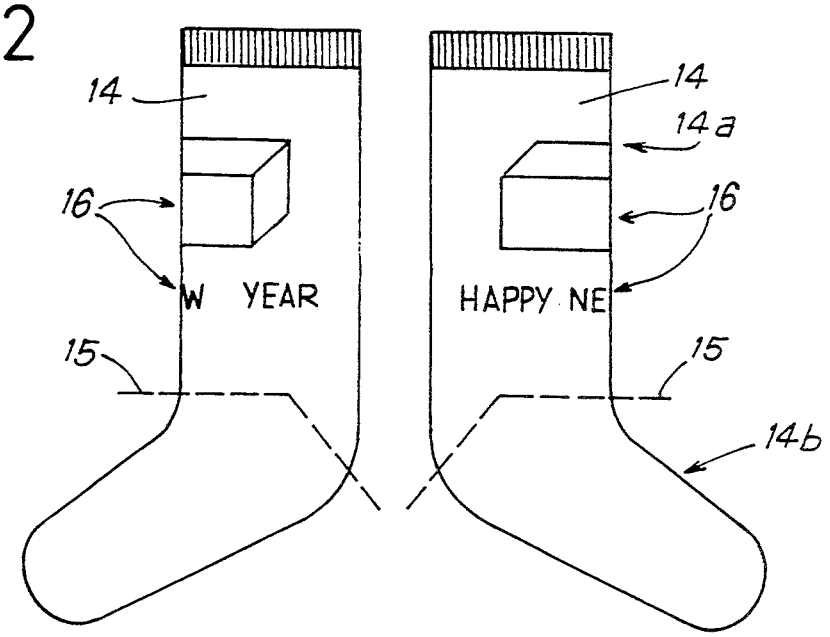
FIG. 2 schematically shows a pair of socks intended to be displayed for sale then packaged by means of the support of FIG. 1.

The support of FIG. 1 which has just been described is used for displaying for sale and for serving as package for a pair of socks 14, such as the one illustrated in FIG. 2. Each sock 14 comprises an open upper part 14*a* and a lower part 14*b*, which are separated in FIG. 2 by a fictitious line 15 shown in dashed lines. The upper part 14*a* is open at its upper end so as to allow the sock to be fitted on the foot; the lower part 14*b* is closed and corresponds to the place for the foot. In the particular example of FIG. 2, the two socks 14 are identical and the upper part 14*a* of each sock 14 comprises on its periphery the same motif 16. In the present case, this motif 16 is constituted by a cube below which is written "HAPPY NEW YEAR". Being given that the motif extends over virtually the-whole periphery of the upper part 14*a* of a sock 14, only part of this motif is visible on each sock 14 in FIG. 2.

Figure 3:
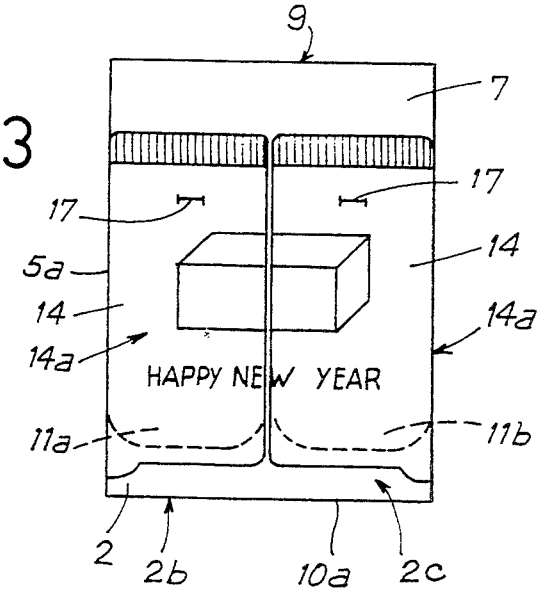
FIG. 3 is a front view of the socks of FIG. 2 fitted on the two tabs of a first lateral flap of the support of FIG. 1, which support is folded in its position for display.

With reference to FIG. 3, when the support of FIG. 1 serves to display the pair of socks 14 of FIG. 2 for sale, only the first lateral flap 7 is folded over the inner face 2*c* of the first principal side 2. The second lateral flap 8, as well as the other two foldable sides 3 and 4 are preferably folded against the outer face 2*d* of the first principal side 2 and, for this reason, are not visible in FIG. 3. The upper part 14*a* of each sock 14 is fitted flat on each of the tabs 11*a* and 11*b* of the first lateral flap 7; each sock 14 is folded into two, so that its lower part 14*b* is positioned against the upper part 14*a* and preferably between this upper part 14*a* and the inner face 2*c* of the side 2, so as not to conceal the motif printed on the upper part 14*a* of the sock. The two socks 14 are presented for sale in the position illustrated in FIG. 3, i.e. placed flat and side by side with respect to each other. Moreover, they are preferably fitted on each tab 11*a* and 11*b* of the first lateral flap 7, being symmetrical with respect to each other, so that, by juxtaposing them, the motif 16 knitted on the periphery of a sock 14 is entirely reproduced. This motif is therefore visible as a whole, which would not be the case if the two socks were superposed or if they were not presented for sale side by side.

Each sock being slightly extensible, the width 1 of a tab 11*a*, 11*b* is preferably slightly larger than the width of a sock 14 before fitting, and the length L of each tab 11*a* and 11*b* of the first lateral flap 7 corresponds virtually to the whole length of the upper part 14*a* of a sock 14. The upper part 14*a* of each sock 14 is thus slightly stretched widthwise, which makes it possible to obtain, on the one hand, a perfect flattening of this upper part over the whole of its length and, on the other hand, a blocking of the sock in position with respect to the tab 11*a* or 11*b* on which it is fitted. It is possible, within the framework of the invention, to provide complementary fastening means 17 between the upper part 14*a* of a sock and the tab 11*a* and 11*b* on which it is fitted. These complementary fastening means are for example a supple tie element passing through the sock and the tab. The two upper (14*a*) and lower (14*b*) parts of a sock 14 may also be blocked in folded position in known manner by means of a sewing thread.

Figure 4:
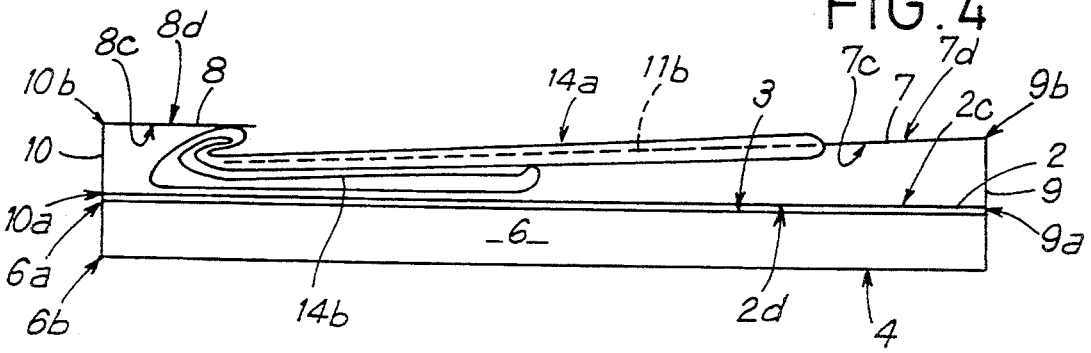
FIG. 4 is a schematic side view of the support and the pair of socks of FIG. 3, after the second lateral flap of the support has been folded in a position where it partly overlaps the pair of socks.

In order to package the pair of socks 14, the second lateral flap 8 is firstly folded over the inner face 2*c* of the first principal side 2, as illustrated in FIG. 4. The second lateral flap 8 advantageously partly overlaps the two socks 14, at the level of their zones of fold, i.e. at the level of their heels. The second principal side 3 is then folded over the inner face 2*c* of the first principal side 2. The inner face 3*c* of this second principal side 3 then comes into contact with the outer faces 7*d* and 8*d* of the two lateral flaps 7 and 8. Thanks to the presence of the adhesive zones 12, the inner face 3*c* of the second principal side 3 is gummed against the outer faces 7*d* and 8*d* of the two lateral flaps 7 and 8. The closure side 4 is then folded so that its inner face 4*c* comes into contact with the outer face of the principal side which is opposite thereto, i.e. in the present case into contact with the outer face 2*d* of the first principal side 2, via the transverse adhesive strip 13. The inner face 4*c* is thus gummed against the outer face 2*d* of the first principal side 2 and consequently a perfect connection is obtained of the two principal sides 3 and 2 in folded position one on the other. The support thus folded constitutes a closed envelope containing the two socks 14. The thickness e of the zones of fold 5, 6, 9 and 10 is advantageously provided to be equal to the thickness of a folded sock 14, so that the envelope obtained has a minimum thickness.

Of course, it is possible to eliminate the longitudinal and transverse adhesive zones 12 and 13, in which case the envelope is closed by introducing the closure side 4 between the pair of socks 14 and the inner face 2*c* of the first principal side 2.

Figure 6:
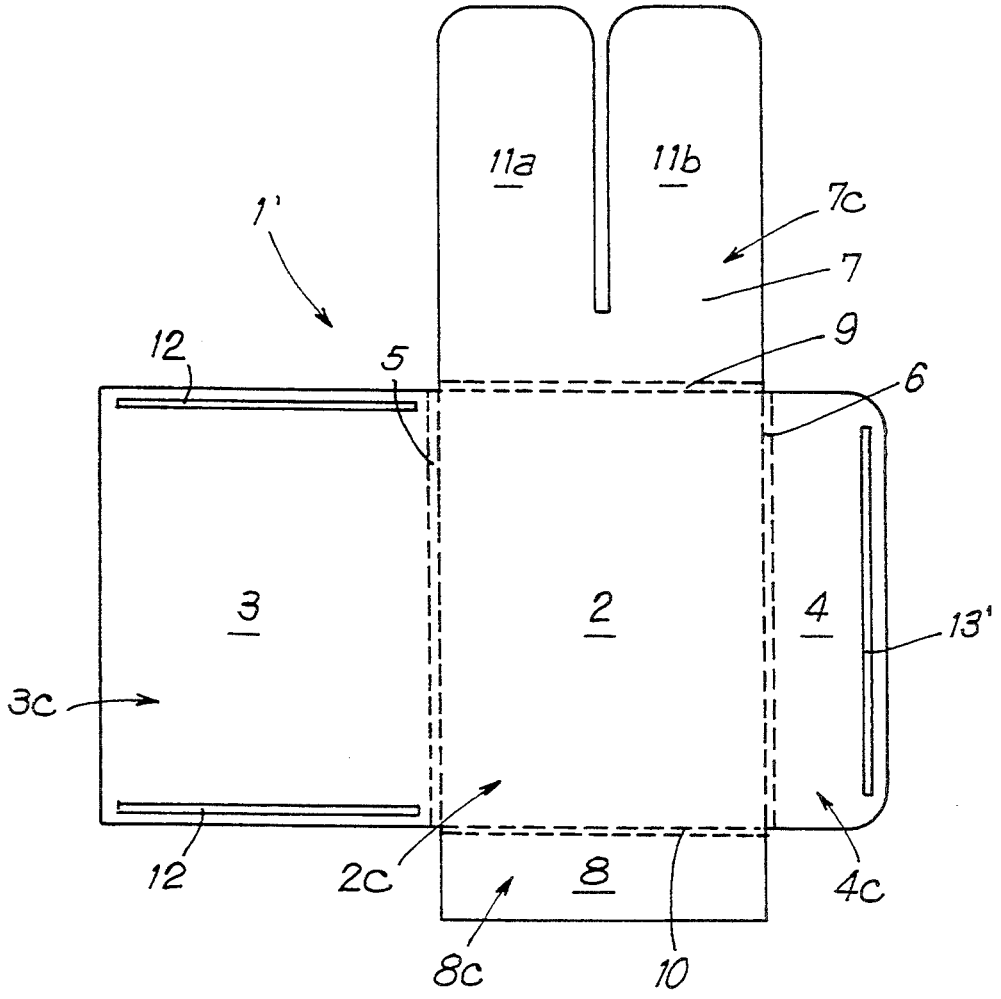
FIGS. 6 and 7 show a sheet of cardboard, flats, constituting two other possible variant embodiments of a foldable support according to the invention.

FIG. 6 shows a possible variant embodiment of a foldable support according to the invention, made from a foldable sheet of cardboard referenced 1'. This second embodiment is very similar to the first one illustrated in FIG. 1, except that the first principal side 2 is located between the second principal side 3 and the closure side 4, the zone of fold 6 separating the first principal side 2 and the closure side 4. To simplify matters, the elements of the sheet 1' have been referenced in FIG. 6 with the same references as the corresponding elements of the foldable sheet 1 of FIG. 1.

Figure 7:
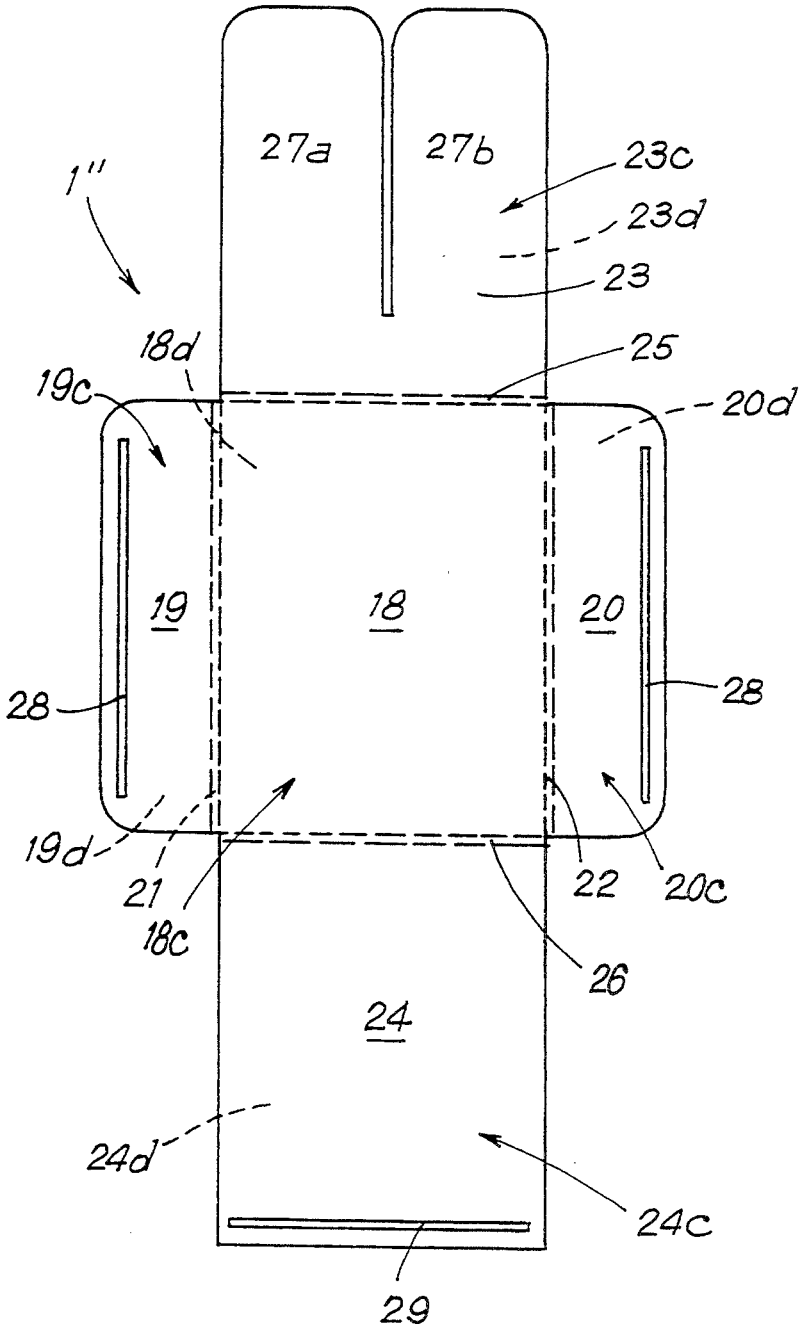

FIG. 7 shows a third possible embodiment of a support of the invention, made from a foldable sheet 1''. This sheet 1'' comprises a rectangular principal part with two transverse zones of fold 21 and 22, which define a first principal side 18 and two closure sides 19 and 20, the first principal side 18 being located between the two closure sides 19 and 20. This sheet 1'' further comprises a first lateral flap 23 which extends a first lateral edge of the first principal side 18, via a zone of fold 25. This first lateral flap 23 is identical to the first lateral flap 7 of the two embodiments illustrated in FIGS. 1 and 6, and terminates in similar manner in two adjacent tabs 27*a* and 27*b* which are adapted to receive, by fitting, the pair of socks 14 of FIG. 2. Finally, sheet 1'' comprises a second lateral flap 24 which extends the other lateral edge of the first principal side 18, via a zone of fold 26. This second lateral flap 24 is substantially identical to the first principal side 18.

On the inner face 24*c* of the second lateral flap 24 there is provided a longitudinal double-face adhesive strip 29 and, on the inner face 19*c* and 20*c* of each closure side 19 and 20, there is provided a transverse double-face adhesive strip 28.

In order to transform the foldable sheet 1'' into a closed envelope, the first lateral flap 23 is folded over the inner face 18*c* of the first principal side 18, then the second lateral flap 24 is folded over the first lateral flap 23. The inner face 24*c* of this second lateral flap 24 comes into contact with the outer face 23*d* of the folded first lateral flap 23, via the adhesive strip 29. The inner face 24*c* of the second lateral flap 24 is thus gummed with the outer face 23*d* of the first lateral flap 23. In order to close the envelope, the two closure sides 19 and 20 are folded over the second lateral flap 24. The inner face 19*c*, 20*c* of each closure side 19, 20 comes into contact with the outer face 24*d* of the second lateral flap 24. The inner face 19*c*, 20*c* of each closure side 19, 20 in folded position is thus gummed on the outer face 24*d* of the second lateral flap 24.

What is claimed is:

1. Combination of a support and of a pair of textile articles of footwear, comprising:

(1) a support made from a foldable sheet of rigid or semi-rigid material, including:

(a) a rectangular principal part with two transverse zones of fold which define three foldable sides including a first principal side, a second side, and a third side, (b) two lateral flaps which respectively extend, via a longitudinal zone of fold, from each lateral edge of the first principal side, a first one of the lateral flaps which terminating in two adjacent tabs which are transverse with respect to the principal part, (c) so that the support forms a closed envelope when the two lateral flaps have been folded over an inner face of the first principal side, and the second and third sides have been folded down, (2) a pair of articles of footwear, each article of footwear having an open upper part and a closed lower part corresponding to the foot, the upper part of each article is fitted over one of the tabs and the lower part of the article is folded against the upper part so that, once the first lateral flap is folded, the articles of footwear are positioned side by side and flat, and when the support is formed into a closed envelope, the second lateral flap overlaps the articles of footwear.

2. The combination of claim 1, the articles of footwear being extensible, the width of each tab of the first lateral flap being greater than the width of the upper part of the articles of footwear, and the length of each tab of the first lateral flap being substantially equal to a length of the upper part of said articles, so that the upper part of each article is perfectly flattened over the whole of its length, having undergone a slight stretching widthwise.

3. The combination of claim 1, wherein the articles of footwear include a same motif on the upper part and are fitted symmetrically with respect to each other so that the upper parts together reproduce substantially the whole motif.

4. The combination of claim 1, wherein the zones of fold of the support have a width substantially equal to the thickness of the folded articles of footwear.

5. The combination of claim 1, a second one of the lateral flaps having a size substantially identical to a size of the first principal side, and the first principal side lying between the second side and the third side, so that the support forms a closed envelope once the second lateral flap is folded over the first lateral flap and the second side and the third side are folded over the second lateral flap.

6. The combination of claim 1, the second side being adjacent to the first principal side, the second side having a size substantially identical to a size of the first principal side; and the third side being a closure side connecting the first principal side and the second side when the support forms a closed envelope, and when the first principal side and the second side are folded.

7. The combination of claim 6, comprising a longitudinal adhesive zone on an outer face of each lateral flap, so that the outer face of each lateral flap may be gummed in folded position against an inner face of the second side; and a transverse adhesive zone on each lateral flap, so that an inner face of the closure side may be gummed against an outer face of the first principal side.

8. The combination of claim 7, further comprising:

a longitudinal adhesive zone on an inner face of the second flap, so that the second flap can be gummed against an outer face of the first flap; and a transverse adhesive zone on each of the second side and the third side, so that an inner face of the second side and the third side can be gummed against an outer face of the second lateral flap, when the support forms a closed envelope.

* * * * *